US010497526B2

(12) United States Patent
Cho

(10) Patent No.: US 10,497,526 B2
(45) Date of Patent: Dec. 3, 2019

(54) MOLDED-CASE CIRCUIT BREAKER WITH MAIN CONTACT INTERLOCK FEATURE

(71) Applicant: LSIS CO., LTD., Anyang-si, Gyeonggi-do (KR)

(72) Inventor: Seongyeol Cho, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/841,674

(22) Filed: Dec. 14, 2017

(65) Prior Publication Data

US 2018/0247783 A1 Aug. 30, 2018

(30) Foreign Application Priority Data

Feb. 28, 2017 (KR) ..... 10-2017-0026641

(51) Int. Cl.
*H01H 71/12* (2006.01)

(52) U.S. Cl.
CPC ..... *H01H 71/128* (2013.01)

(58) Field of Classification Search
CPC ..... H01H 71/128
USPC ..... 200/335, 336, 329, 332, 5 R, 5 B, 6 R, 200/6 A, 8 A, 6 BA, 19.06, 19.07, 19.18, 200/19.2, 19.22, 19.27, 49, 51.04, 400, 200/410, 416, 470, 273, 320
See application file for complete search history.

(56) References Cited

U.S. PATENT DOCUMENTS

| | | | |
|---|---|---|---|
| 7,482,901 | B2 | 1/2009 | Watanabe et al. |
| 2007/0021557 | A1 | 1/2007 | Lee et al. |
| 2007/0215577 | A1 | 9/2007 | Park |
| 2009/0039988 | A1 | 2/2009 | Song |

FOREIGN PATENT DOCUMENTS

| | | | |
|---|---|---|---|
| CN | 101038833 | A | 9/2007 |
| CN | 101364506 | A | 2/2009 |
| CN | 103797558 | A | 5/2014 |
| CN | 104658822 | A | 5/2015 |
| EP | 0978860 | A2 | 2/2000 |
| JP | 2011142012 | A | 7/2011 |
| JP | WO2014057517 | A1 | 8/2016 |
| KR | 200419048 | Y1 | 6/2006 |

(Continued)

OTHER PUBLICATIONS

European Search Report for related European Application No. 17192102.6; report dated Apr. 24, 2018; (8 pages).

(Continued)

*Primary Examiner* — Anthony R Jimenez
(74) *Attorney, Agent, or Firm* — K&L Gates LLP

(57) ABSTRACT

The present invention relates to a molded-case circuit breaker with a main contact interlock feature preventing improper operation of a tripping mechanism that trips main contacts when the main contacts fuse together. The circuit breaker includes a handle that transfers the user's operational force; a switch lever rotatably mounted on a side plate and connected to the handle, with a pressure portion formed on a part of it; a shaft link, one end of which is rotatably mounted on a shaft pin, that has a contact region on the top; a trip lever rotatably mounted on the side plate, one end of which is slidably connected to the shaft link, and the other end of which is connected to a nail of a tripping mechanism, wherein, if the pressure portion makes contact with the contact region, the trip lever rotates the nail.

7 Claims, 10 Drawing Sheets

(56) References Cited

FOREIGN PATENT DOCUMENTS

| | | | |
|---|---|---|---|
| KR | 20100079907 | A | 7/2010 |
| KR | 100996806 | B1 | 11/2010 |
| KR | 101003607 | B1 | 12/2010 |

OTHER PUBLICATIONS

Chinese Office Action for related Chinese Application No. 201711434800.4; dated Feb. 28, 2019; (10 pages).

MOLDED-CASE CIRCUIT BREAKER WITH MAIN CONTACT INTERLOCK FEATURE

CROSS-REFERENCE TO RELATED APPLICATION

Pursuant to 35 U.S.C. § 119(a), this application claims the benefit of earlier filing date and right of priority to Korean Application No. 10-2017-0026641, filed on Feb. 28, 2017, the contents of which are incorporated by reference herein in its entirety.

BACKGROUND OF THE INVENTION

1. Field of the Invention

The present invention relates to a molded-case circuit breaker with a main contact interlock feature, and more particularly, to a molded-case circuit breaker with a main contact interlock feature which prevents improper operation of a tripping mechanism that trips main contacts when the main contacts fuse together.

2. Description of the Conventional Art

In general, a molded-case circuit breaker (MCCB) is an electrical device that protects a circuit and a load by automatically interrupting the circuit when there is an electrical overload or short circuit. The circuit breaker typically includes a terminal portion provided on the front and rear and forming a circuit connection, a mechanism divided into a stationary contact and a movable contact and mechanically opening and closing a circuit, a trip portion detecting an over-current or short-circuit current in the circuit and causing the mechanism to trip, and an extinguisher for extinguishing an arc produced when interrupting a fault current.

In the circuit breaker, the mechanism requires a function for verifying main contact positions, in addition to its basic functions such as allowing and breaking current. Verification of main contact positions is for the purpose of allowing the user to recognize circuit conditions and preventing safety incidents by holding the handle of the mechanism in the input position to prevent it from moving to the off position when a movable contact and a fixed contact fuse together while current is applied (conducting state). This function of the circuit breaker which prevents the handle from moving to the off position is also called an "isolation feature".

The main contact position verification function may be implemented by blocking or tripping. In the blocking method, the handle is not moved to the off (interrupted) state even if the user exerts force to the handle to move it to the off position. On the other hand, in the tripping method, when the user operates the handle to move it to the off position, the mechanism is tripped so that the handle is held in the on state (or tripped state).

Now, a description will be given of a molded-case circuit breaker that can maintain the main contact position verification function, reduce the number of parts, and improve improper operation of the tripping mechanism by using the tripping method.

FIGS. 1 to 3 depict a switch mechanism of a molded-case circuit breaker according to the conventional art. The figures show the off state, on state, and fused state, respectively.

The switch mechanism 1 includes a switch lever 4 that is rotatably mounted on a lever shaft 17 mounted on a part of a side plate 2 and moves to the on, off, and tripped positions, a handle 3 that is attached to the switch lever 4 and applies manual operational force to it, an upper link 6 rotatably mounted on a latch 19*a*, a lower link 7 rotatably mounted on a first shaft pin 15*a* of a shaft 14, a link shaft 18 to which the upper link 6 and the lower link 7 are attached, and a main spring 5 that is attached to the link shaft 18 and provides elasticity.

When the user turns the handle 3 from the off state (interrupted state) to the on state, the link shaft 18 rotates counterclockwise by the force of the main spring 5 attached to the switch lever 4 and pulls the upper link 6 and the lower link 7 into the shape of a nearly-straight line and rotates the shaft 14. A movable contact 12 of a contact region 11 comes into contact with a fixed contact 13 and creates a conducting state (on state). The link shaft 18 is placed on the left of the lever shaft 17, and the switch lever 4 is locked in the on state. A transition from the on state to the off state occurs in the opposite way.

Meanwhile, a tripping mechanism for implementing the main contact position verification function is mounted on the right side of the mechanism. The tripping mechanism for implementing the main contact position verification function includes a first link 8 connected to a second shaft pin 15*b*, a second link 9 connected to a first link 8, a trip link 10 that rotates by the force of the second link 9, a nail 16, and a latch holder 19*b*. The second link 9 has a long hole along which a pin slides.

In the case of a normal interruption, the shaft 14 rotates, so the first link 8 connected to the second shaft pin 15*b* moves downward, thus keeping the trip link 10 from operating (see FIG. 2 and then FIG. 1). That is, in normal on and off actions, the first link 8 and the second link 9 move within a certain area and do not affect the trip link 10.

When the contacts fuse together as shown in FIG. 3, the shaft 14 does not rotate beyond a predetermined range. Thus, the first link 8 does not move downward but is pushed by a pressure portion 4*a* of the switch lever 4 and rotates clockwise and pushes the second link 9. Accordingly, the second link 9 rotates the trip link 10, and the trip link 10 rotates the nail 16, thereby releasing the latch holder 19*b*. The latch holder 19*b* releases the latch 19*a*, thereby tripping the switch mechanism 1.

Because the link shaft 18 of the tripped switch mechanism 1 is positioned more to the left than the lever shaft 17, the switch lever 4 is always in the on state (or tripped state). As such, the positions of the main contacts of the circuit breaker can be detected, and a fusion of the contacts can be detected.

However, in the conventional art, the tripping mechanism for verifying main contact positions includes a first link 8, a second link 9, and a trip link 10, and the first link 8 can move relatively freely. Therefore, there is a risk that, when the switch mechanism 1 performs an on operation, the second link 9 might be pushed by the collision of the first link 8 on it and touches the trip link 10, causing the switch mechanism 1 to trip.

SUMMARY OF THE INVENTION

The present invention has been made in an effort to solve the above-described problems, and an aspect of the present invention is to provide a molded-case circuit breaker with a main contact interlock feature which prevents improper operation of a tripping mechanism that trips main contacts when the main contacts fuse together.

An exemplary embodiment of the present invention provides a molded-case circuit breaker with a main contact position interlock feature, the circuit breaker including: a handle that transfers the user's operational force; a switch lever rotatably mounted on a side plate and connected to the handle, with a pressure portion formed on a part of it; a shaft link, one end of which is rotatably mounted on a shaft pin, that has a contact region on the top; a trip lever rotatably mounted on the side plate, one end of which is slidably connected to the shaft link, and the other end of which is connected to a nail of a tripping mechanism, wherein, if the pressure portion makes contact with the contact region, the trip lever rotates the nail.

An arc-like slit is formed through the shaft link, and a protrusion is formed at one end of the trip lever to be slidably inserted into the slit.

The protrusion makes contact at a point on the upper end of the slit when in the off state, and the protrusion makes contact with a point on the lower end of the slit when the contacts fuse together.

The slit is divided into a first part extending from the upper end point to the point where the protrusion is in the on state, and a second part extending from the point where the protrusion is in the on state to the lower end point, and the second part slopes at an angle less than 45 degrees with respect to a contact surface where the contact region makes contact with the pressure portion.

The first part bulges toward the left or right, and the second part bulges toward the left.

The trip lever has a rotating shaft hole at the center, with a first arm at one side and a second arm at the other side.

The trip lever has a torsion spring that exerts a clockwise torque on the trip lever.

The first arm has a spring support that supports one end of the torsion spring.

A supporting piece is formed on a part of a base mold, and the second arm has a stopper that makes contact with the supporting piece.

A molded-case circuit breaker with a main contact interlock feature according to an embodiment of the present invention has the advantage of preventing tripping caused by unintended rotation by means of a stopper on a trip lever.

Moreover, with a simple configuration made up of a shaft link and a trip lever, an interlock feature (isolation feature) is enabled in a stable manner when contacts fuse together, which helps enhance product reliability. Therefore, higher productivity and higher durability can be achieved.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE PREFERRED EMBODIMENTS

Figure 1:
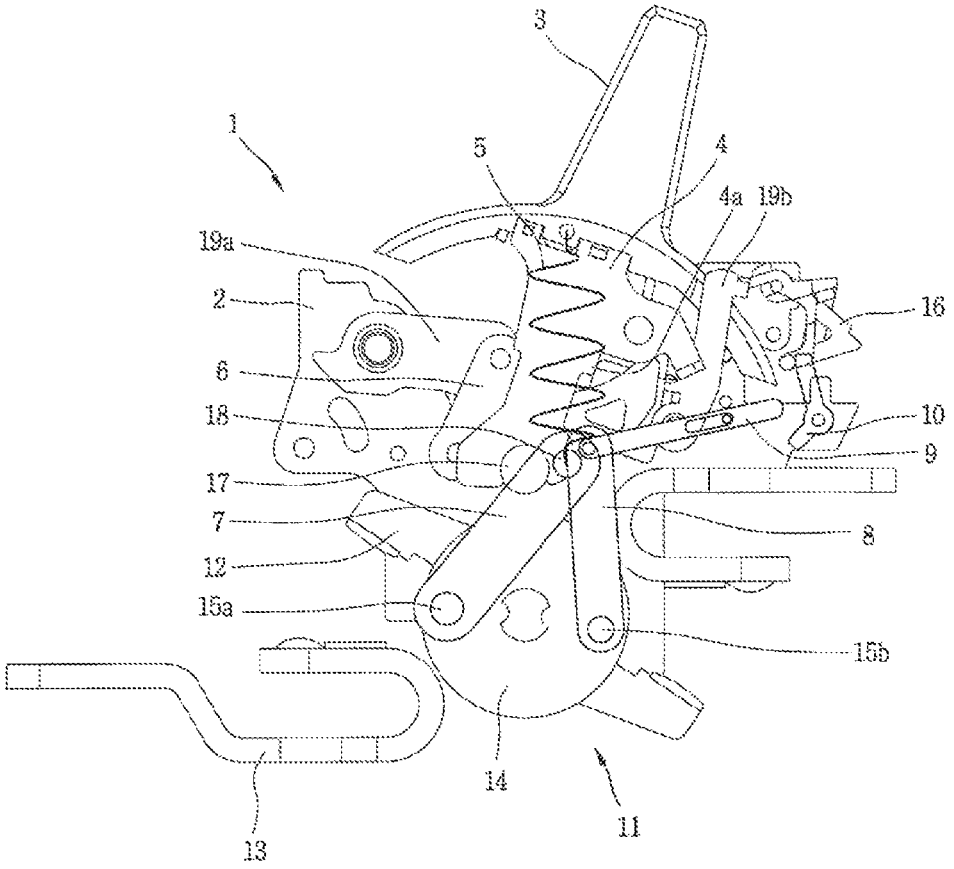
Fig. 1 Prior Art
FIGS. 1 to 3 depict a switch mechanism of a molded-case circuit breaker according to the conventional art, which show the off state, on state, and fused state, respectively.
Figure 2:
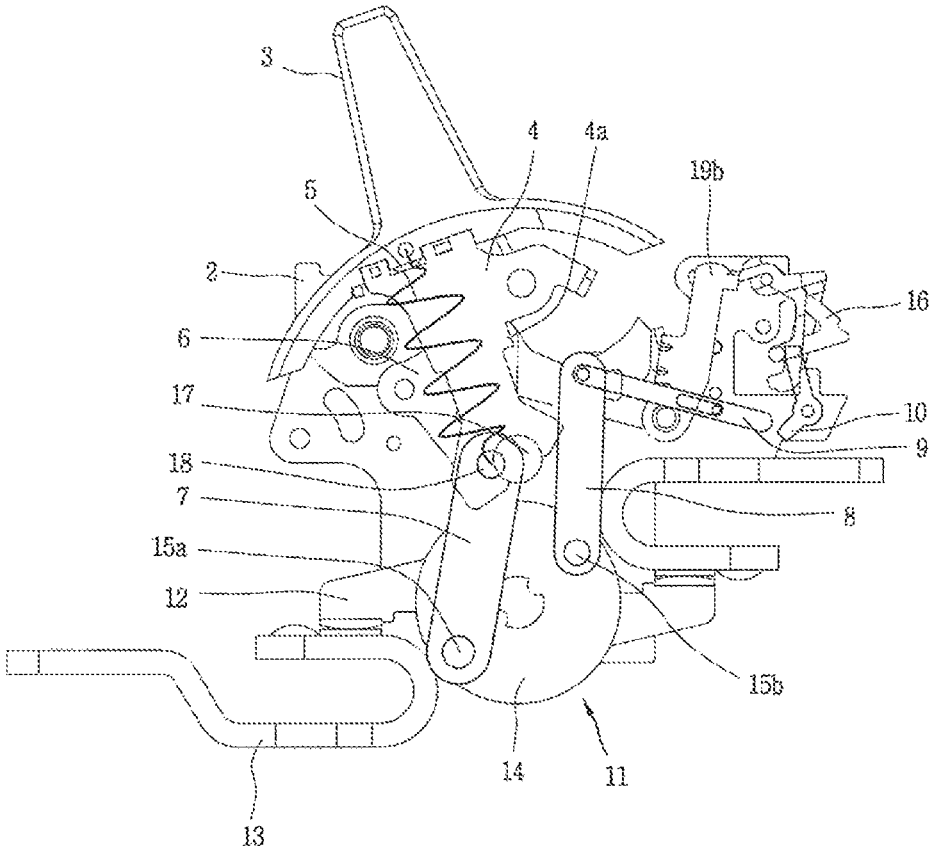
Fig. 2 Prior Art
Figure 3:
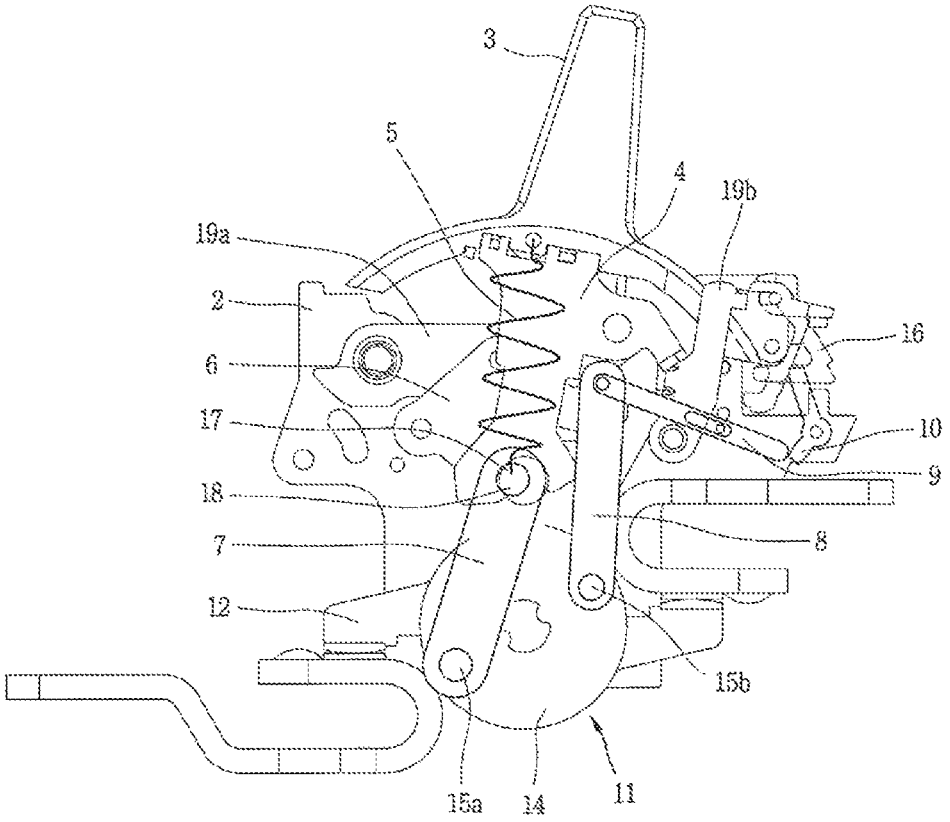
Fig. 3 Prior Art

While the invention has been shown and described with respect to the preferred embodiments, it will be understood by those skilled in the art that various changes and modifications may be made without departing from the spirit and scope of the invention as defined in the following claims.

A molded-case circuit breaker with a main contact position interlock feature according to embodiments of the present invention will be described in detail with reference to the drawings.

A molded-case circuit breaker with a main contact position interlock feature according to an embodiment of the present invention includes: a handle 20 that transfers the user's operational force; a switch lever 22 rotatably mounted on a side plate 21 and connected to the handle 20, with a pressure portion 22*a* formed on a part of it; a shaft link 30, one end of which is rotatably mounted on a shaft pin 27*b*, that has a contact region 30*a* on the top; a trip lever 31 rotatably mounted on the side plate 21, one end of which is slidably connected to the shaft link 30, and the other end of which is connected to a nail 32 of a tripping mechanism, wherein, if the pressure portion 22*a* makes contact with the contact region 30*a*, the trip lever 31 rotates the nail 32.

Figure 4:
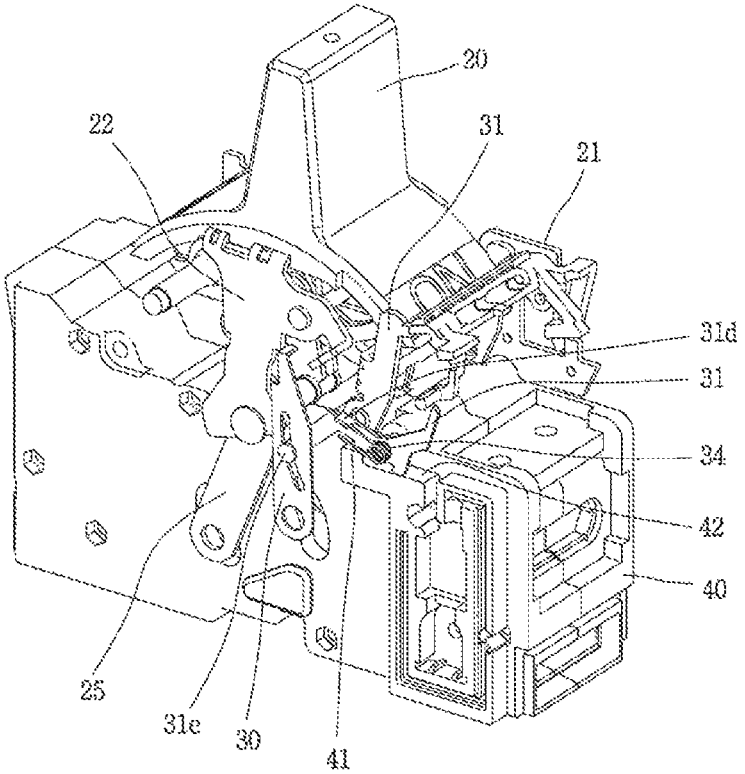
FIG. 4 depicts a partial perspective view of a molded-case circuit breaker according to an embodiment of the present invention.
Figure 5:
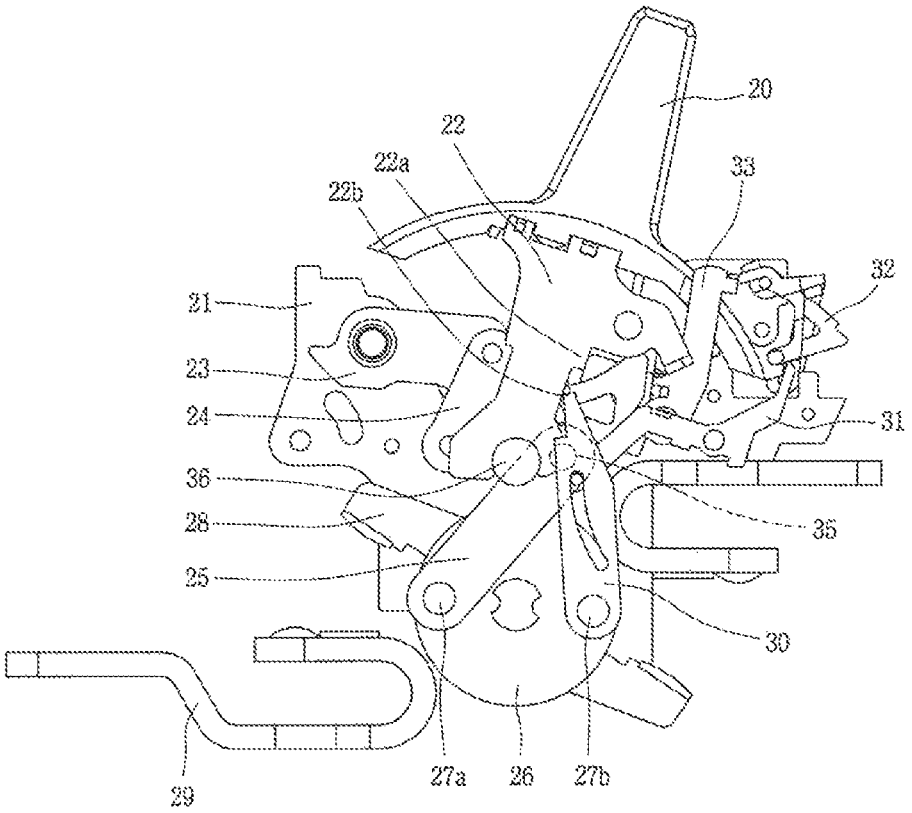
FIGS. 5 to 8 depict vertical cross-sectional views of a switch mechanism of a molded-case circuit breaker according to an embodiment of the present invention, which show the off state, on state, fused state before operation, and fused state after operation, respectively.

FIG. 4 depicts a partial perspective view of a molded-case circuit breaker according to an embodiment of the present invention. FIGS. 5 to 8 depict vertical cross-sectional views of a switch mechanism of a molded-case circuit breaker according to an embodiment of the present invention. The figures show the off state, on state, fused state before operation, and fused state after operation, respectively.

The contact part includes a movable contact 28, a fixed contact 29, and a shaft 26. The movable contact 28 is mounted on the shaft 26 and rotates with the rotation of the shaft 26. The shaft 26 has a pair of shaft pins 27*a* and 27*b*. The pair of shaft pins 27*a* and 27*b* serve to transfer the actuating force of the switch mechanism to the shaft 26. A lower link 25 is mounted on any one 27*a* of the pair of shaft pins 27*a* and 27*b* to transfer switching power, and a shaft link 30 is mounted on the other shaft pin 27*b* to perform an interlock feature (isolation feature) when the main contacts fuse together.

The switch mechanism includes a toggle link mechanism and a release mechanism that are mounted on a pair of side plates 21. The toggle link mechanism includes a handle 20, a switch lever 22 that is connected to the handle 20 and can be turned to the on or off position, and an upper link 24 and a lower link 25 that are connected by a link shaft 35. The upper link 24 is rotatably mounted on a lath 23, and the lower link 25 is rotatably mounted on any one shaft pin 27*a*.

A pressure portion 22*a* and a link receiving portion 22*b* are formed on one side of the switch lever 22. The pressure portion 22*a* may protrude, and the link receiving portion 22*b* may be recessed.

When the user pushes the handle 20 to the on position (see FIG. 6), a main spring (not shown) attached to the link shaft 35 pulls the link shaft 35 to the left of a lever shaft 36, and the upper link 24 and the lower link 25 are straightened into a nearly-straight line. This rotates the shaft 26 counterclockwise and brings the movable contact 28 into contact with the fixed contact 29, thereby allowing current to be carried to the circuit.

On the contrary, when the user pushes the handle 20 to the off position (see FIG. 5), the main spring (not shown) pulls the link shaft 35 to the right of the lever shaft 36. Then, the upper link 24 and the lower link 25 rotate the shaft 26 clockwise as they are bent in an L-shape, and the movable contact 28 is detached from the fixed contact 29, thereby causing the circuit to trip.

The tripping mechanism includes a nail 32 rotatably mounted on one side of the switch mechanism, a latch holder 33 restrained by the nail 32, and a latch 23 restrained by the latch holder 33. As for a trip operation (see FIGS. 7 and 8), when the nail 32 rotates clockwise, the latch holder 33 is released and rotates clockwise. Thus, the latch 23 is released and the latch 23 rotates counterclockwise, and therefore the upper link 24 is pulled, thereby moving the link shaft 35 to the left of the lever shaft 36.

Figure 9A:
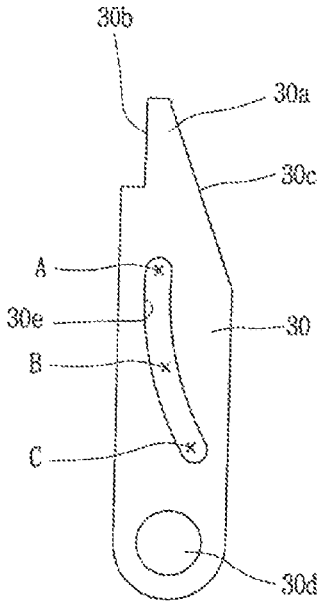
FIGS. 9A, 9B, and 10 depict front views of a shaft link and a trip lever that are applied to a molded-case circuit breaker according to an embodiment of the present invention.
Figure 9B:
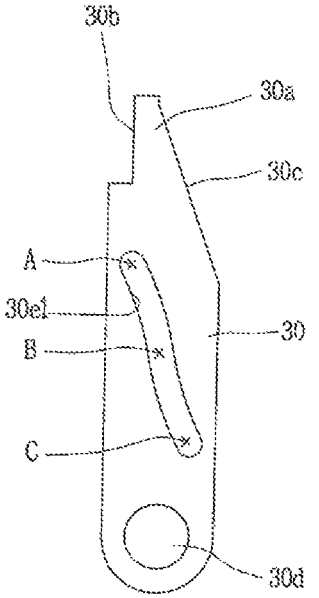
Figure 10:
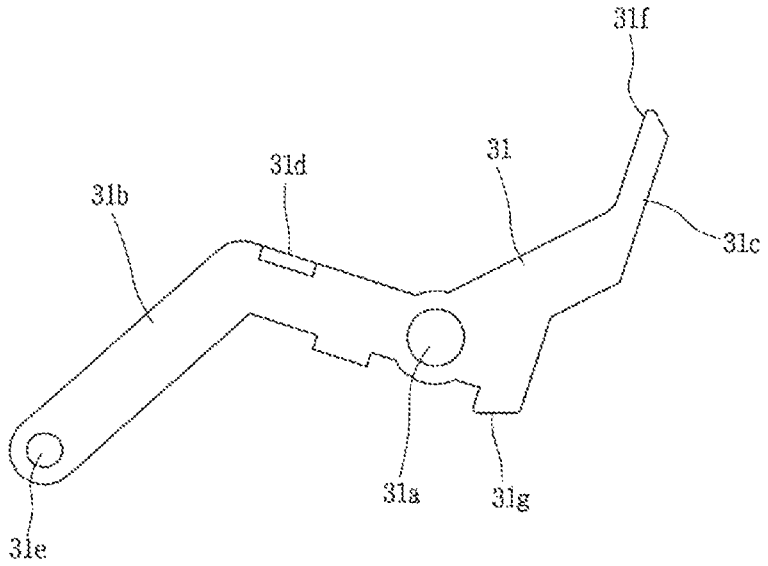

FIGS. 9A, 9B, and 10 depict front views of a shaft link and a trip lever that are applied to a molded-case circuit breaker according to an embodiment of the present invention. An interlock device for verifying main contact positions that is applied to the circuit breaker according to an embodiment of the present invention includes a shaft link and a trip lever.

The shaft link 30 may be formed from a long, flat plate. The contact region 30*a* protrudes from the top end of the shaft link 30. A contact surface 30*b* is formed in the shape of a straight line on one side of the contact region 30*a*. A sloping surface 30*c* may be formed on the other side of the contact region 30*a*. The contact surface 30*b* is a surface with which the pressure portion 22*a* of the switch lever 22 makes contact and on which force is exerted.

A coupling hole 30*d* is formed at the lower end of the shaft link 30 so as to be rotatably attached to the shaft pin 27*b*. The shaft link 30 may rotate about the coupling hole 30*d*.

An arc-like slit 30*e* is formed at the center of the shaft link 30. The slit 30*e* provides a curved path to which one end (a protrusion 31*e*) of the trip lever 31 is slidably attached. It is assumed that a point on the upper end of the slit 30*e* is A, the point at the center of the slit 30*e* where the protrusion 31*e* is in the on position is B, and a point on the lower end of the slit 30*e* is C. Also, it is assumed that the part from A to B is a first part AB and the part from B to C is a second part BC. The embodiment of FIG. 9A illustrates that both the first part AB and second part BC of the slit 30*e*1 bulge toward the left. The embodiment of FIG. 9B illustrates that the first part AB of the slit 30*e*1 bulges toward the right and the second part BC bulges toward the left.

Preferably, in the on state, the second part BC corresponds to a cylindrical surface around which the protrusion 31*e* rotates. Also, it is preferable that the second part BC slopes at an angle less than 45 degrees with respect to the contact surface 30*b*. Thus, when the switch lever 22 applies force towards the right, the protrusion 31*e* is pushed away.

The trip lever 31 is rotatably mounted on a side plate 21. The trip lever 31 may have the shape of two arms that extend to both sides of a rotating shaft hole 31*a*. The rotating shaft hole 31*a* may be formed at the center of the trip lever 31 and rotatably mounted on the side plate 21 or a base mold 40.

A first arm 31*b* is formed at one side of the trip lever 31, and a second arm 31*c* is formed at the other side. The first arm 31*b* and the second arm 31*c* may be bent in opposite directions.

A spring support 31*d* protrudes from the first arm 31*b*. The spring support 31*d* supports one end of a torsion spring 34 (see FIG. 4). The torsion spring 34 is mounted around the rotating shaft hole 31*a*, with one end being supported on the spring support 31*d*, and the other end being supported on a first supporting piece 41 of the base mold 40. Accordingly, the trip lever 31 receives a clockwise torque.

The protrusion 31*e* to be slidably inserted into the slit 30*e* of the shaft link 30 is formed at the end of the first arm 31*b*. The protrusion 31*e* may slide along the slit 30*e*.

A nail pressure portion 31*f* is formed at the end of the second arm 31*c*. The nail pressure portion 31*f* is mounted in such a way that it makes contact with the nail 32. A stopper 31*g* protrudes from the second arm 31*c*. The stopper 31*g* is supported on a second supporting piece 42 of the base mold 40 and serves to keep the trip lever 31 from rotating any further.

The first supporting piece 41 and the second supporting piece 42 protrude from the base mold 40. The first supporting piece 41 supports the other end of the torsion spring 34, and the second supporting piece 42 supports the stopper 31*g* of the trip lever 31. Since the trip lever 31 is supported by the stopper 31*g*, improper operation of the tripping mechanism is prevented even if a switching impact is generated.

Referring to FIGS. 5 to 8, operation of a molded-case circuit breaker with an isolation feature according to an embodiment of the present invention will be described.

Figure 6:
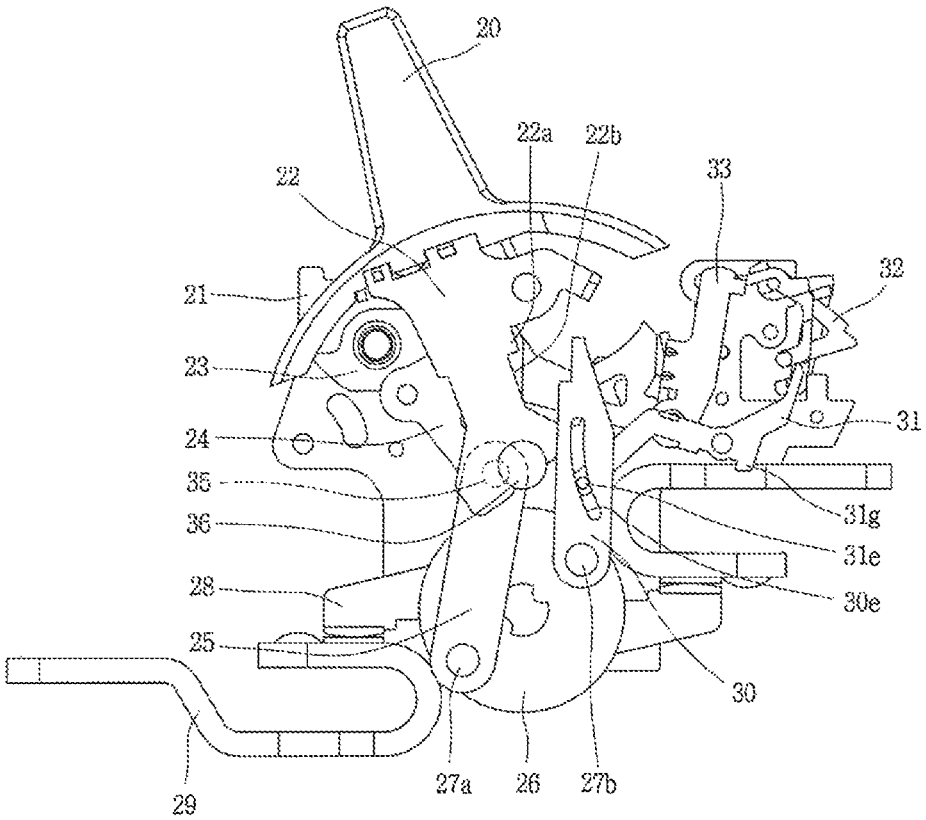

When the user pushes the handle 20 from the on state to the off position as shown in FIG. 6 (when the user rotates the handle 20 in the clockwise direction shown in the figure), the main spring (not shown) pulls the link shaft 35 to the right of the lever shaft 36. Then, the upper link 24 and the lower link 25 rotate the shaft 26 clockwise as they are bent in an L-shape, and the movable contact 28 is detached from the fixed contact 29, thereby causing the circuit to trip (see FIG. 5). In this case, the shaft link 30 moves downwards along the shaft 26. Since the protrusion 31*e* of the trip lever 31 is stuck in the slit 30*e* of the shaft link 30, the shaft link 30 moves along a certain trajectory. In the off position, the shaft link 30 is inserted into the link receiving portion 22*b* of the switch lever 22. However, the shaft link 30 does not make contact with the link receiving portion 22*b*. In normal on and off actions, the trip lever 31 does not move. Moreover, in normal on and off actions, the protrusion 31*e* of the trip lever 31 moves in the first part AB of the slit 30*e*.

Figure 7:
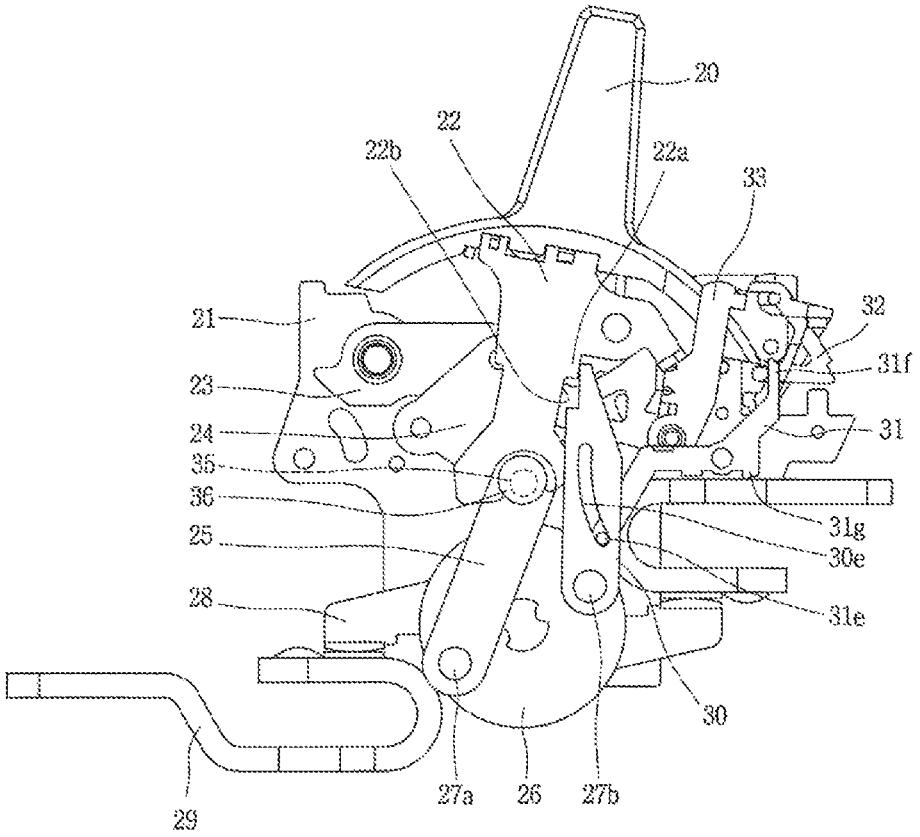
Figure 8:
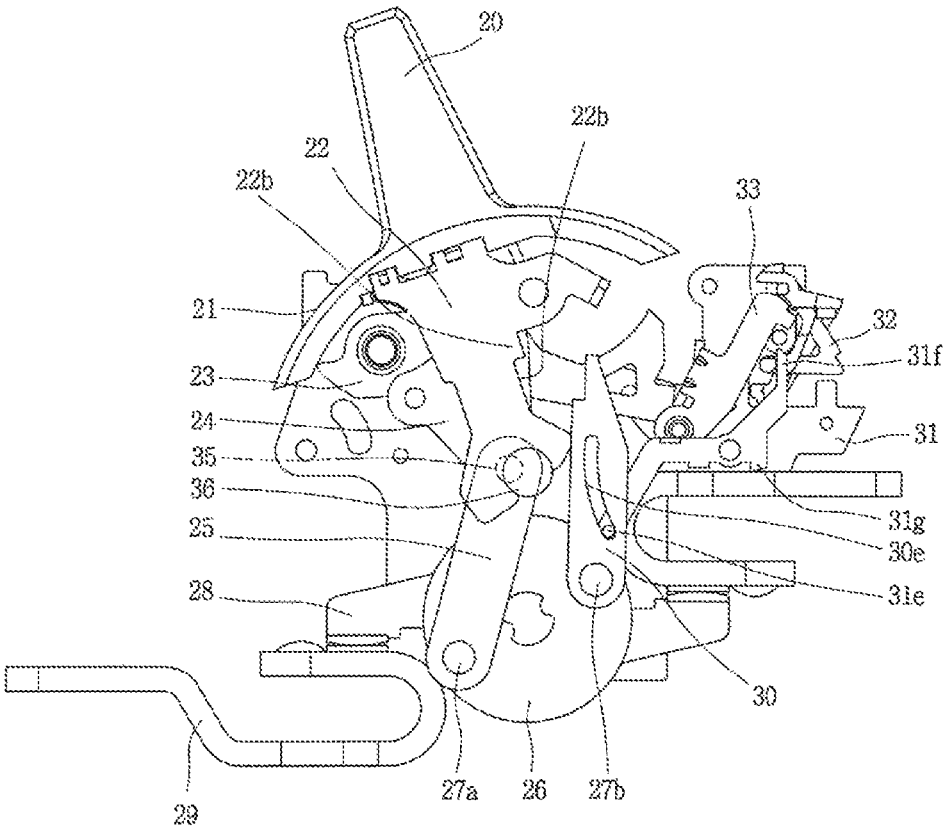

In a case where the contacts fuse together as shown in FIG. 7, if the user pushes the handle 20 to the off position, the shaft 26 does not rotate and therefore the shaft link 30 does not move downward. The pressure portion 22*a* of the switch lever 22 touches the contact surface 30*b* of the shaft link 30 and pushes the shaft link 30. As the shaft link 30 rotates, the protrusion 31*e* of the trip lever 31 is pushed by the slit 30*e* and rotates counterclockwise. As the trip lever 31 rotates, the nail pressure portion 31*f* pushes the nail 32, thereby releasing the latch holder 33. In conjunction with this, the latch 23 is released from the latch holder 33, causing the switch mechanism to trip. When the contacts fuse together, the protrusion 31*e* of the trip lever 31 moves in the second part BC of the slit 30*e*.

A molded-case circuit breaker with a main contact interlock feature according to an embodiment of the present invention has the advantage of preventing tripping caused by unintended rotation by means of a stopper on a trip lever.

Moreover, with a simple configuration made up of a shaft link and a trip lever, an interlock feature (isolation feature) is enabled in a stable manner when contacts fuse together, which helps enhance product reliability. Therefore, higher productivity and higher durability can be achieved.

What is claimed is:

1. A molded-case circuit breaker with a main contact position interlock feature, the circuit breaker comprising:
   - a handle that transfers a user's operational force;
   - a switch lever rotatably mounted on a side plate and connected to the handle, with a pressure portion formed on a part of the switch lever;
   - a shaft link, one end of which is rotatably mounted on a shaft pin, that has a contact region on a top portion of the shaft link;

a trip lever rotatably mounted on the side plate, a first end of which is slidably connected to the shaft link, and a second end of which is connected to a nail of a tripping mechanism, wherein, when the pressure portion makes contact with the contact region, the trip lever rotates the nail, wherein an arc-like slit is formed through the shaft link, and a protrusion is formed at the first end of the trip lever to be slidably inserted into the slit, and wherein the protrusion makes contact at a point on an upper end of the slit when in an off state, and the protrusion makes contact with a point on a lower end of the slit when in a fused state.

2. The circuit breaker of claim 1, wherein the slit is divided into a first part extending from the upper end of the slit to a first point where the protrusion is in an on state, and a second part extending from the first point to the lower end point, and the second part slopes at an angle less than 45 degrees with respect to a contact surface where the contact region makes contact with the pressure portion.

3. The circuit breaker of claim 2, wherein the first part bulges toward a left or right direction, and the second part bulges toward the left direction.

4. The circuit breaker of claim 1, wherein the trip lever has a rotating shaft hole at a center of the trip lever, with a first arm at a first side of the trip lever and a second arm at a second side of the trip lever.

5. The circuit breaker of claim 1, wherein the trip lever has a torsion spring that exerts a clockwise torque on the trip lever.

6. The circuit breaker of claim 5, wherein the first arm has a spring support that supports one end of the torsion spring.

7. The circuit breaker of claim 4, wherein a supporting piece is formed on a part of a base mold, and the second arm has a stopper that makes contact with the supporting piece.

* * * * *